166-66 SR

1/13/81 OR 4,244,424

536 537

United States Patent [19]

Talbot

[11] 4,244,424

[45] Jan. 13, 1981

[54] MAGNETIC CASING DEPTH MARKER

[75] Inventor: Kenneth J. Talbot, Thibodeaux, La.

[73] Assignee: Chromalloy American Corporation, St Louis, Mo.

[21] Appl. No.: 24,523

[22] Filed: Mar. 28, 1979

[51] Int. Cl.[3] ..... E21B 17/00

[52] U.S. Cl. ..... 166/66; 166/255

[58] Field of Search ..... 166/66, 65 M, 250, 255, 166/241; 73/151

[56] References Cited

U.S. PATENT DOCUMENTS

| | | | |
|---|---|---|---|
| 2,986,417 | 5/1961 | Baker | 166/241 X |
| 3,086,589 | 4/1963 | McGowen, Jr. | 166/65 M |
| 3,106,960 | 10/1963 | Doak | 166/66 |
| 3,171,488 | 3/1965 | Ownby | 166/65 M |
| 3,513,912 | 5/1970 | Boop | 166/65 M |
| 3,637,033 | 1/1972 | Mayall | 166/65 M |

*Primary Examiner*—William F. Pate, III

[57] ABSTRACT

A magnetic casing depth marker which includes a plurality of axially upper and lower magnets dispersed circumferentially about the exterior of the casing. Each magnet has radially inner and outer faces that are magnetized such that the inner face is of one pole and the outer face is of the other. The inner faces of all of the axially upper magnets are of one pole and the inner faces of the axially lower magnets are of the other pole, whereby a strong magnetic field is focused into the interior of the casing.

13 Claims, 4 Drawing Figures

FIG. 1
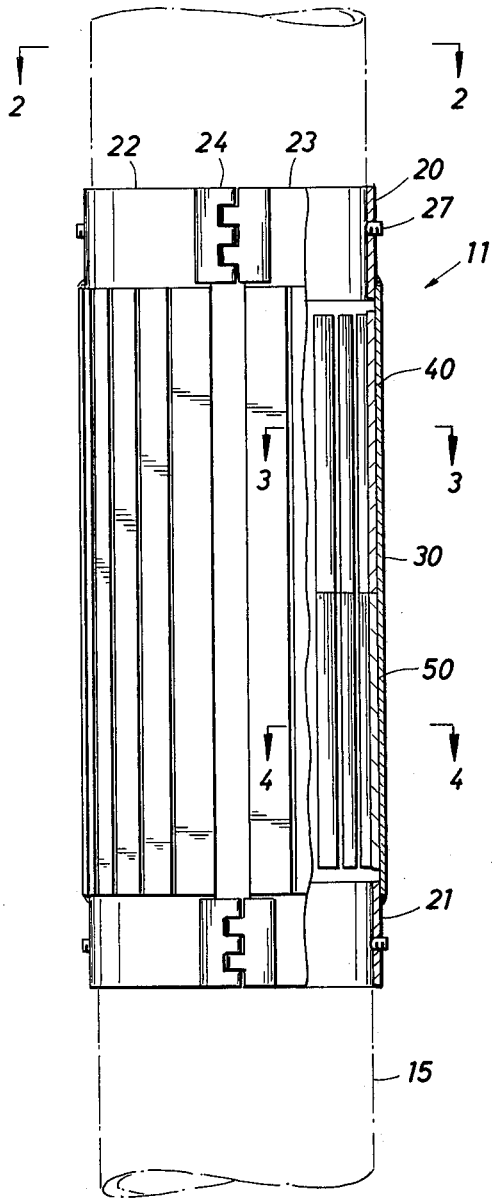
FIG. 2
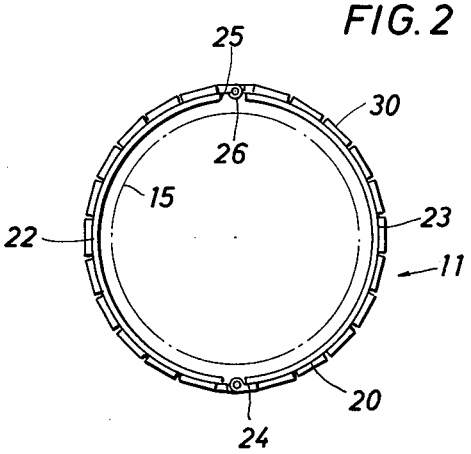
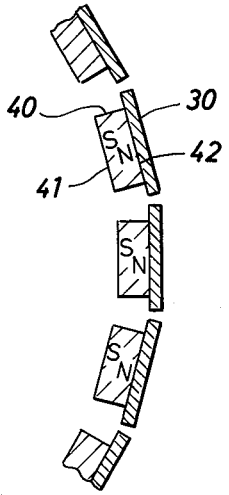
FIG. 3
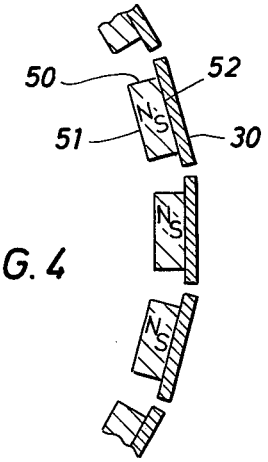
FIG. 4

MAGNETIC CASING DEPTH MARKER

BACKGROUND OF THE INVENTION

1. Field of the Invention

The present invention relates generally to apparatus for marking a well casing depth, and more particularly to a magnetic device adapted to actuate a casing collar locater log.

2. Description of the Prior Art

At the completion of drilling an oil or gas well, hydrocarbon bearing formations are usually detected and located by means of logging tools run on the end of electrical cables inside the drilled or open hole. If it is determined from these open hole logging devices that production from the hydrocarbon formations is feasible, then casing is run across these formations and the annular area between casing and hole is filled with cement.

In order to accurately perforate the producing formations through casing and cement so that hydrocarbons can flow into the well, it is essential the locations of these producing formations be established so that the perforating gun can be properly positioned inside the casing prior to its firing. This is typically performed with cased hole logging tools, which usually include a radioactive tool run in tandem with a casing collar locating tool.

The radioactive tool is able to look through the casing and detect and locate the same producing formations logged initially in the open hole and the collar locating tool defines where the casing joints are coupled together with respect to the producing formations. The location of these formations and the casing collars are recorded simultaneously to produce a correlation log.

Although it would seem that the perforating gun could be positioned inside the casing simply by honoring depth measurements taken by directly measuring the electrical cable spooled into and out of the hole, large discrepancies would occur in the actual downhole position of the perforating gun with respect to depth measurements taken with either the open hole or cased hole correlation log. This would occur because of differences in:

1. Cable and tool weights and their physical properties;
2. Downhole conditions (temperature, pressure, directional deviations);
3. Surface elevations which alter cable tension which results in elongational differences. This cable stretch or slack will in turn cause subsequent depth correlation errors.

It also would seem simple to position the perforating gun by running it in conjunction with the radioactive tool used in obtaining the correlation log. However, since these radioactive tools are extremely delicate and expensive and since tremendous shocks are generated when perforation charges are fired, perforating guns are normally positioned utilizing a collar locater in tandem with the perforating gun.

Although the collar log method of positioning perforating guns has been reduced to common operating practice, it is not a foolproof positioning means.

For example, most casing collars are approximately equidistant apart along the casing and it is difficult to keep track of precisely which collar the collar locater has located. This problem is enhanced in very deep wells where there are naturally more collars to keep track of. This problem becomes more severe when reperforating an older well, because it is not uncommon to have depth variations as much as 20 feet.

In these instances the operator is faced with guessing which collar located with the collar log corresponds with its counterpart on the correlation log. This guess would be in lieu of making some positive collar correlation that would define the position of the perforating gun in the hole.

Another common example is a failure of the casing collar locater to detect the casing couplings. This occurs when premium-seal or integral joint pipe couplings are employed, when non-magnetic alloy tubulars for corrosive environments are used, or when casing that has been magnetized by drilling operations that have been conducted through said casing are logged. In these cases, the operator is forced to rerun a correlation log and work from depth measurements, which has its inaccuracies as previously described, or tie into some reference point a considerable distance away from the formation, such as the bottom of the well, which itself is only an approximation. In the above instances, the operator is forced into making an erroneous attempt to perforate the well.

There have been numerous attempts to positively and unambiguously mark a location, or reference point upon a casing; however, none of the prior devices have been entirely successful. One such device comprises a collar adapted for attachment about the exterior of the casing. The theory of operation of that device is that the casing collar locater log is responsive to metal mass in its vicinity. However, that device has not proved successful and it has been determined that the casing collar locater log is responsive to changes in internal diameter of the casing rather than metal mass.

Another device, shown in U.S. Pat. No. 3,106,960, comprises a collar adapted for placement about the casing, and includes a pair of diametrically opposed magnetic inserts on the interior of the collar. The magnetic field produced by the device of the '960 patent has little or no tendency to penetrate the casing, and therefore the device is virtually undetectible.

Other devices have been proposed, which place magnets on the interior of the casing. Examples of such devices are shown in U.S. Pat. Nos. 3,513,912; 3,105,551; 3,105,546; 3,105,548; 3,105,549; 3,105,550; 3,171,486; 3,171,488; 3,187,815; 3,198,255; and 3,105,547. All of those devices are disadvantageous in that they must be used with specially fabricated sections of casing and are therefore not usable with standard commercially available casing.

SUMMARY OF THE INVENTION

It is therefore an object of the present invention to provide an apparatus that may be attached to the outside of standard commercially available casing and that will positively and unambiguously mark a location that can be detected by a casing collar locater log.

Briefly stated, the device of the present invention comprises at least one axially upper and at least one axially lower magnet. Each magnet has a pair of faces and is magnetized such that one face is of one pole and the other face is of the other pole. Means are provided for supporting the axially upper and lower magnets in contact with the casing such that the magnets are axially aligned and such that the polarity of the radially interface of the axially upper magnet is opposite that of the axially lower magnet, whereby a magnetic field is directed inwardly of the casing.

The support means includes a pair of collars having a backing plate extending therebetween. The magnets are affixed to the interior of the backing plate.

BRIEF DESCRIPTION OF THE DRAWING

FIG. 1 is a side elevation view, partially broken away, showing the apparatus of the preferred embodiment of the invention.

FIG. 2 is a sectional view taken along line 2—2 of FIG. 1 showing the arrangement of the upper collar and backing plates.

FIG. 3 is a sectional view taken along line 3—3 of FIG. 1 illustrating the arrangement of the axially upper magnets.

FIG. 4 is a sectional view taken along line 4—4 of FIG. 1 showing the arrangement of the axially lower magnets.

DESCRIPTION OF THE PREFERRED EMBODIMENT

Referring now to the drawing, the marking device of the preferred embodiment of the present invention is designated generally by the numeral 11.

Marking device 11 is comprised generally of a pair of collars 20 and 21, a plurality of backing plates 30, a plurality of axially upper magnets 40, and a plurality of axially lower magnets 50. Marking device 11 is adapted for attachment about the exterior of a casing, which is shown in phantom in FIGS. 1 and 2 and designated by the numeral 15.

Upper collar 20, which is substantially identical to lower collar 21, includes a pair of semi-circular sections 22 and 23, that are joined together by a pair of hinges 24 and 25. Collar 20 is thus adapted to be latched onto casing 15 by the removal and reinsertion of a hinge pin, as for example hinge pin 26 of hinge 25. The diameter of collar 20 is slightly larger than the external diameter of casing 15. Collar 20 is held in axial position upon casing 15 by means of set screws, as for example set screw 27, which is threadedly engaged through section 23 of upper collar 20.

Collars 20 and 21 are spaced axially apart by means of a plurality of elongated rectangular steel backing plates 30. Backing plates 30 are disposed circumferentially about collars 20 and 21 and are attached thereto by welding or the like. It will, of course, be recognized that backing plates 30 could be replaced by a pair of semi-circular cylindrical sections. However, the thin elongated segmental nature of backing plates 30 offers several advantages over a cylindrical structure. For example, marking device 11 must be available in several different diameters in order to be used with different diameter casings. If a cylindrical backup device were used, then several sizes of cylinders would have to be stocked. The narrow width of each backing plate 30 allows the fabrication of structures of different diameters that approximate a cylinder. Moreover, because of the configuration of magnets 40 and 50 of the preferred embodiment, as will be detailed hereinafter, the internal surface of the backup structure must present a plurality of flat sides. If a one-piece cylindrical device were used, then such flat surfaces would have to be machined.

Each backing plate 30 has attached thereto, by adhesive or the like, an axially upper magnet 40 and axially lower magnet 50, each formed of a strongly magnetic material, as for example, barium ferrite. All axially upper magnets 40 and axially lower magnets 50 are of substantially equal length and are disposed circumferentially about the interior of marking device 11. Magnets 40 and 50 are arranged such that each axially upper magnet 40 is axially aligned with a corresponding axially lower magnet 50 and in the preferred embodiment, each axially upper magnet 40 abuts its corresponding axially lower magnet 50.

Referring now to FIG. 3, each axially upper magnet 40 has a radially inner face 41 and a radially outer face 42. Each upper magnet 40 is magnetized such that inner face 41 is south and outer face 42 is north. Similarly, referring to FIG. 4, each axially lower magnet 50 has a radially inner face 51 and a radially outer face 52. Each axially lower magnet 50 is magnetized such that inner face 51 is north and outer face 52 is south.

It may thus be seen that the inner faces of all axially upper magnets 40 are south for their entire length and the inner faces of axially lower magnets 50 are north for their entire length. The effect of this arrangement of magnets is generally analogous to placing a plurality of horseshoe magnets circumferentially about casing 15. Lines of magnetic flux flow between the inner face 41 of each upper magnet 40 and inner face 51 of corresponding lower magnet 50, and from outer face 52 to inner face 42 through backing plate 30. It can be appreciated that the greater the number of magnets 40 and 50 disposed about marking device 11, the greater the field produced therein and the greater will be the penetration of such field into the interior of casing 15. The greater field will be produced both by the increased amount of magnetic material and by the focusing effect of the interaction of circumferentially adjacent magnets. For example, in FIG. 3, as more magnets 40 are added to device 11, the separation between circumferentially adjacent magnets 40 becomes smaller, thereby causing the flux from the edges of face 41 to fringe radially inwardly rather than bend radially outwardly and into face 42. Additionally, the strength of the field and its penetration of the casing is enhanced by the steel backing plates 30, which conduct the flux between outer faces 42 and 52.

It will, of course, be recognized that magnets 40 and 50 could be replaced by cylindrical magnets having inner faces of one pole and outer faces of the other pole. However, such magnets would be expensive to fabricate and a stock of various diameter cylinders would have to be maintained. It will further be recognized that the arrangement of magnets wherein inner faces of axially upper magnets 40 are south and inner faces 51 of axially lower magnets 40 are north is illustrative only and that the polarities could be reversed, i.e., marking device 11 could be run upside down.

It has been found that the effectiveness of marking device 11 is enhanced if collars 20 and 21 are of a nonmagnetic material, as for example, stainless steel. It is believed that nonmagnetic collars 20 and 21 cause flux from the axially outer ends of inner faces 41 and 51 of upper magnets 40 and 50 respectively to connect through the interior of casing 15, rather than to circulate outwardly to complete themselves at outer faces 42 and 52 respectively.

In operation, marker device 11 would be latched about casing 15 at some point and fixed axially in place by means of set screws 27. Casing 15 would then be run into the bore hole and cemented in place. As a casing collar locater log is run out of the hole at standard logging speed, it will indicate on a trace the location of each casing collar that it passes. As the casing collar locater log passes marking device 11, a trace will be produced that has an amplitude approximately as great as that of a collar. The trace produced by marking device 11 will stand out clearly because it is between adjacent collars and will therefore mark unambiguously a reference location on the casing.

Further modifications and alternative embodiments of the apparatus of this invention will be apparent to those skilled in the art in view of this description. Accordingly, this description is to be construed as illustrative only and is for the purpose of teaching those skilled in the art the manner of carrying out the invention. It is to be understood that the form of the invention here as shown and described is to be taken as the presently preferred embodiment, various changes may be made in the shape, size and arrangement of parts, for example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. Apparatus for marking a location on a well casing, which comprises:

an axially upper magnet in contact with the exterior of said casing, said axially upper magnet having radially inner and outer faces, said inner face being of one pole and said outer face being of the other pole;

and an axially lower magnet substantially axially aligned with said upper magnet in contact with said exterior of said casing, said axially lower magnet having radially inner and outer faces, said inner face being of one pole and said outer face being of the other pole, wherein the poles of said upper and lower magnet are opposite.

2. The apparatus as claimed in claim 1, wherein each of said magnets comprises an elongated rectangular strip, wherein the long sides of each of said strips are parallel to the axes thereof and said axes are coincident with each other and parallel to the axis of said casing.

3. The apparatus as claimed in claim 1, wherein said upper magnet abuts said lower magnet.

4. Apparatus for marking a location of a well casing, which comprises:

an axially upper magnet having radially inner and outer faces, said inner face being of one pole and said outer face being of the other pole;

an axially lower magnet having radially inner and outer faces, said inner face being of one pole and said outer face being of the other pole, wherein said pole of said inner face of said lower magnet is opposite that of said upper magnet;

and means for supporting said inner faces of said upper and lower magnets in contact with the exterior of said casing in end-to-end fashion, such that the axes of said upper and lower magnets are coincident and substantially parallel to the axis of said casing.

5. The apparatus as claimed in claim 4, wherein said supporting means comprises:

a pair of axially spaced apart collars adapted for attachment about said casing;

a plate extending between said collars;

and means for affixing said outer faces of said upper and lower magnets to said plate.

6. The apparatus as claimed in claim 5, wherein said collars comprise a nonmagnetic material.

7. The apparatus as claimed in claim 5, wherein said plate comprises a ferromagnetic material.

8. The apparatus as claimed in claim 4, wherein said upper magnet abuts said lower magnet.

9. Apparatus for marking a location on a well casing, which comprises:

a pair of collars adapted for attachment to the exterior of said casing;

means circumferentially about said collars for spacing said collars axially apart;

a plurality of axially upper magnets affixed circumferentially about the interior of said spacing means, each of said upper magnets comprising an elongated rectangular strip having an axis parallel to the axis of said casing and having radially inner and outer faces, wherein said inner faces are of one pole and said outer faces are of the other pole;

and a plurality of axially lower magnets affixed circumferentially about the interior of said spacing means, each of said lower magnets comprising an elongated rectangular strip having an axis parallel to the axis of said casing and having radially inner and outer faces, wherein said inner faces are of one pole and said outer faces are of the other pole and said poles of said lower magnets are opposite those of said upper magnets.

10. The apparatus as claimed in claim 9, wherein said spacing means comprises a plurality of flat elongated plates circumferentially spaced about and extending axially between said collars.

11. The apparatus as claimed in claim 10, wherein said elongated plates are comprised of a ferromagnetic material.

12. The apparatus as claimed in claim 9, wherein each of said collars is hinged, whereby said apparatus may be latched about said casing.

13. The apparatus as claimed in claim 9, wherein said collars comprise a nonmagnetic material.

* * * * *